US005809592A

United States Patent [19]

McAllister

[11] Patent Number: 5,809,592

[45] Date of Patent: *Sep. 22, 1998

[54] SELF-ERECTING PLAY YARD STRUCTURE

[75] Inventor: Robert McAllister, Encinitas, Calif.

[73] Assignee: Creative Toy Products, Inc., Solana Beach, Calif.

[ * ] Notice: The term of this patent shall not extend beyond the expiration date of Pat. No. 5,642,538.

[21] Appl. No.: 851,519

[22] Filed: May 5, 1997

Related U.S. Application Data

[63] Continuation of Ser. No. 531,156, Sep. 18, 1995, Pat. No. 5,642,538.

[51] Int. Cl.[6] ..... A47D 7/00

[52] U.S. Cl. ..... 5/99.1; 5/97

[58] Field of Search ..... 5/98.1, 99.1, 97; 135/124, 125, 126, 905

[56] References Cited

U.S. PATENT DOCUMENTS

| | | | |
|---|---|---|---|
| 3,165,760 | 1/1965 | Abajian | 5/99.1 X |
| 3,534,750 | 10/1970 | Kolozsvary . | |
| 3,540,450 | 11/1970 | Osterhoudt . | |
| 3,960,161 | 6/1976 | Norman . | |
| 4,154,253 | 5/1979 | Norman . | |
| 4,317,315 | 3/1982 | LeBlang . | |
| 4,825,892 | 5/1989 | Norman . | |
| 4,858,634 | 8/1989 | McLeese . | |
| 4,899,496 | 2/1990 | Chew, II | 5/99.1 X |
| 5,038,812 | 8/1991 | Norman . | |
| 5,163,461 | 11/1992 | Ivanovich et al. . | |
| 5,337,772 | 8/1994 | Habchi | 135/125 |
| 5,396,917 | 3/1995 | Hazinski et al. | 135/125 |
| 5,601,105 | 2/1997 | Blen et al. | 135/126 |
| 5,642,538 | 7/1997 | McAllister | 5/99.1 |
| 5,645,096 | 7/1997 | Hazinski et al. | 135/126 |
| 5,676,168 | 10/1997 | Price | 135/126 |

FOREIGN PATENT DOCUMENTS

| | | | |
|---|---|---|---|
| 545 637 | 6/1993 | European Pat. Off. | 135/125 |
| WO 94/11600 | 5/1994 | WIPO . | |

*Primary Examiner*—Michael F. Trettel
*Attorney, Agent, or Firm*—Baker & Maxham

[57] ABSTRACT

A play yard which is light, portable and operable for easily and quickly transforming between a collapsible configuration and an expanded configuration. The play yard opens up automatically by simply releasing the frame and allowing it to unfold. The play yard includes a frame formed of a flexible material including a first bottom loop forming a rectangular shape and a second elevated loop contacting the first loop at two points. An envelope made of laminar material is attached at selected points to the frame to form a partially enclosed play area. An opening in a top portion of the envelope permits access to the enclosed play area. In a preferred embodiment, the play yard has a removable top for covering the opening when desired.

18 Claims, 4 Drawing Sheets

SELF-ERECTING PLAY YARD STRUCTURE

This application is a continuation of application Ser. No. 08/531,156, filed Sep. 18, 1995, now U.S. Pat. No. 5,642,538.

BACKGROUND OF THE INVENTION

1. Technical Field

The present invention relates to play yards and more particularly to a play yard which is collapsible and which opens spontaneously.

2. Discussion

Portable play yards (also known as playpens) are useful for confining infants and toddlers to an enclosed and safe play space. The typical portable play yard has a rigid frame covered in a fabric and/or mesh with a rigid panel for a floor. These play yards are generally foldable by a hinged mechanism which connects sections of the rigid frame.

One problem with conventional play yards is that they are often relatively heavy and bulky. Because of the rigid frame, even in the folded-up configuration play yards are typically very large, and thereby require considerable space for storage. This also makes them unwieldy for transporting. Furthermore, the rigid frame with hinge mechanism is generally relatively time consuming to assemble and may require considerable manual effort during the folding and unfolding process. In addition, the hinged rigid frame design is relatively expensive to produce. Also, the typical conventional play yard has an open top. This open top configuration, however, sometimes is less than desirable, for example, outdoors in the sun because this design exposes the child to direct sunlight.

Thus, it would be desirable to provide a play yard which overcomes some or all of the aforementioned disadvantages. In particular, it would be desirable to provide such a play yard which is quick and easy to assemble, is light in weight, and which folds up into an very compact package. Furthermore, it would be desirable to provide these features in a play yard which has a relatively simple construction and can be made at very low cost. Also it would be desirable to provide which can easily be configured to have a partial or complete top structure over the play yard to protect the child from the sun and other elements.

SUMMARY OF THE INVENTION

In accordance with the present invention there is provided an improved play yard. The play yard of the present invention is portable and operable for easily and quickly transforming between a collapsible configuration and an expanded configuration. In a preferred embodiment the play yard includes a frame formed from a flexible material formed into at least two loops including a first planar loop forming a rectangular shape and a second elevated loop contacting the first loop at two points and otherwise elevated from the first loop. The play yard also includes an envelope made of laminar material attached at selected points to the frame to form a partially enclosed play area. The envelope includes a floor portion substantially enclosing the first loop, a top portion including sides, substantially enclosing the second loop. The top is open permitting access to the enclosed play area.

As a result, the play yard of the present invention has a number of advantages. It opens up automatically by simply releasing the frame and allowing it to unfold. It is also very easy to fold up into a very compact package. It is light, and is simple and inexpensive to construct. The play yard also has an attachable section for covering the opening in the top which allows the top to be covered completely.

BRIEF DESCRIPTION OF THE DRAWINGS

The various advantages of the present invention will become apparent to one skilled in the art by reading the following specification and by reference to the following drawings in which.

DETAILED DESCRIPTION OF THE PREFERRED EMBODIMENTS

Figure 1:
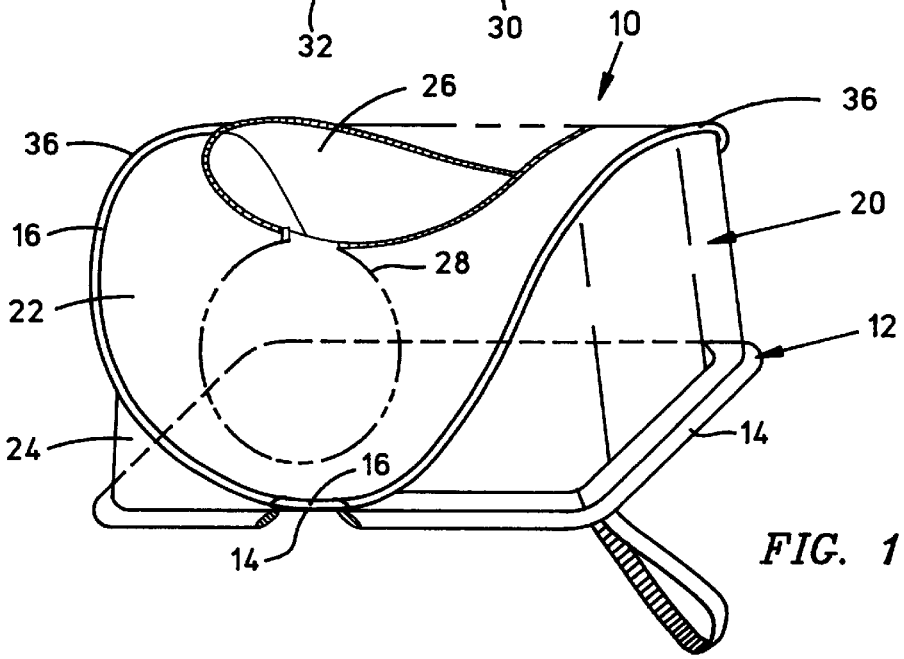
FIG. 1 is a perspective view of the play yard in accordance with the present invention.

Referring now to FIG. 1 there is shown a play yard 10 in accordance with a preferred embodiment of the present invention. The play yard 10 comprises a frame 12 made of two loops of a resilient filiform member, referred to as an armature. The first armature 14 forms the base of the play yard and is in the shape of a rectangle with rounded corners. Also, the frame 12 includes a second armature 16 which is substantially elevated from the first armature 14 and supporting the top and side portions of the play yard 10. The first and second armatures 14, 16 are connected at the base in a manner described in more detail below.

The armatures 14, 16 may be made from a variety of resilient materials having memory, such a steel. In a preferred embodiment, the armature may be comprised of steel wire in the range from 10 gauge to 6 gauge depending on the strength and size required. While steel such as ASTMA 229 steel wire is preferred, alternative materials may be used such as fiberglass and rattan.

The frame 12 is covered by an envelope 20 made of a pliable laminar material. This material may comprise vinyl coated nylon, canvas, mesh, or any other pliable light weight material. In the preferred embodiment, a top portion of the envelope 22 is made of a nylon mesh having openings approximately ½ inch across. The mesh may also be made with small openings (such as a screen) to prevent mosquitos and other bugs from entering the play yard. End portions of the envelope 24, in the preferred embodiment, are comprised of an opaque nylon material. The opaque ends of the play yard 24 provide the play yard with a means to block light and wind from entering the play yard at the ends, this is particularly useful in the embodiments which incorporate a mesh material for the top.

Figure 3:
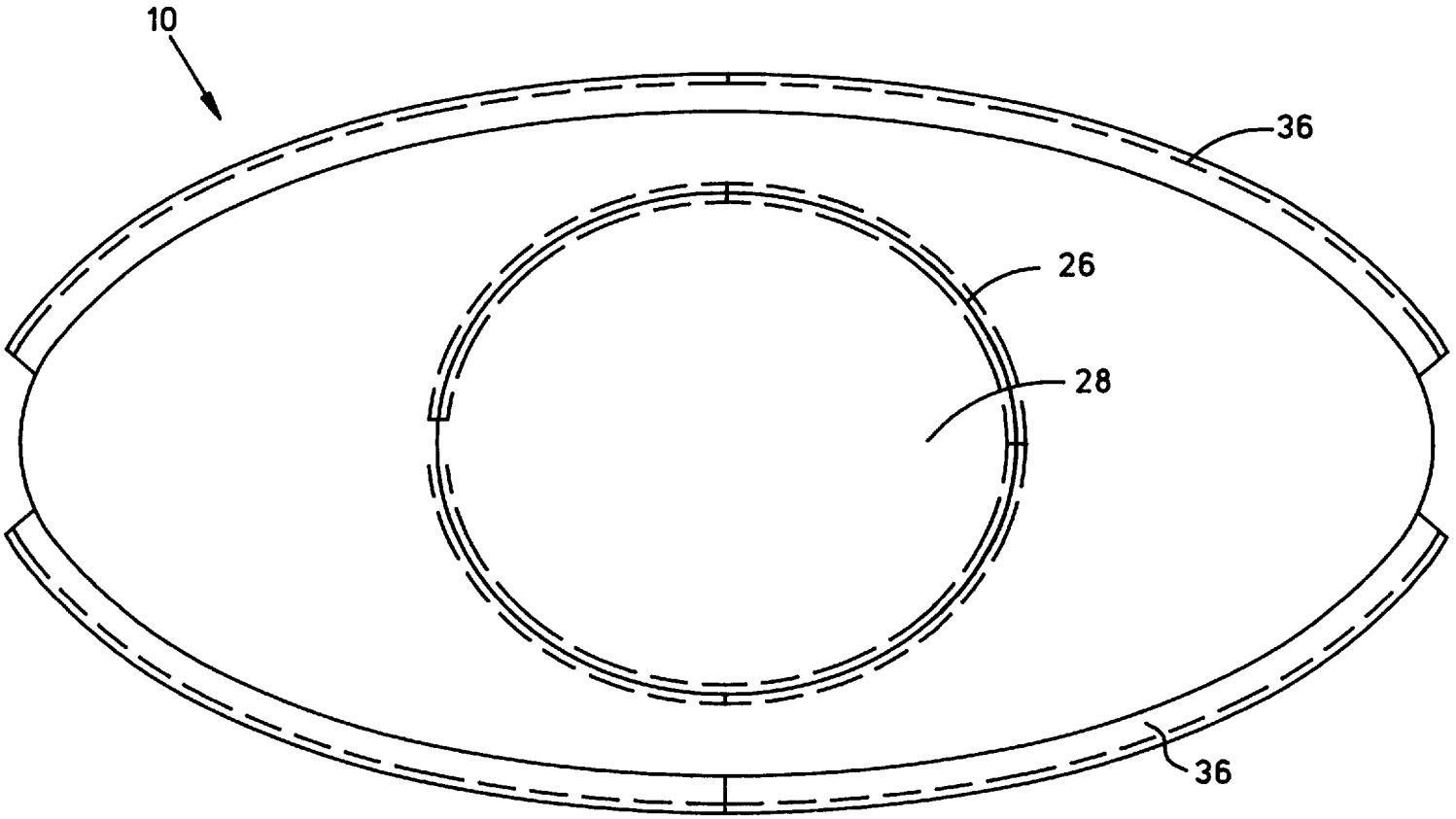
FIG. 3 is a top view of the play yard in accordance with the present invention.

As shown in FIGS. 1 and 3, the top portion 22 is open at opening 26 which permits a child or objects to be placed inside and removed from the play yard 10. A cover 28 is removably attached to the top 22 of the play yard. The cover 28 is at least as large as the opening 26 and contains a conventional means for affixing to the top such as velcro, snaps or zippers (not shown). The cover 28 can serve a number of functions. It may prevent bugs or other objects from entering the play yard or it may shield the play yard occupant from the sun.

In an alternative embodiment, the cover 28 is made considerably larger than the top. Thus, where the top is made of a mesh material, the cover 28 may be employed as a sun shield and/or bug protector to prevent bugs from entering the play yard through the mesh. It should also be noted that the size and shape of both the opening 26 and cover 28 can be varied to provide for ease of access to the interior of the play yard 10. For example, the size of the opening 26 which will provide convenient access may depend on its shape and other factors such as the overall height of the play yard 10.

Figure 2:
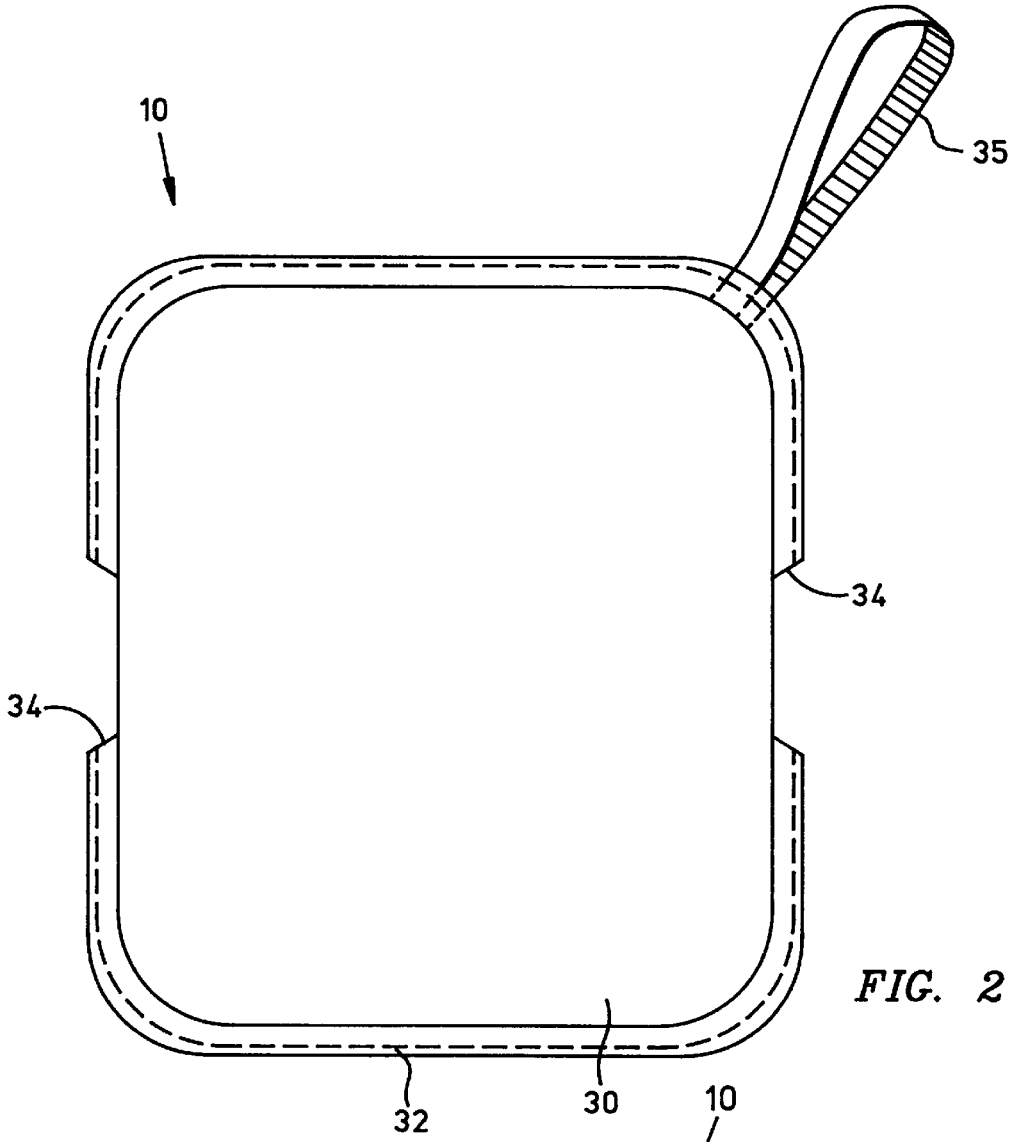
FIG. 2 is a bottom view of the floor of the play yard in accordance with the present invention.

Referring now to FIG. 2, a bottom view of the play yard 10 is shown. The play yard has a floor 30 which substantially encloses the bottom armature 14. The floor may be made of the same material as the envelope 20 and will preferably be an opaque material and not mesh to prevent objects or debris from entering the play yard from the ground or floor on which the play yard is placed.

The floor 30 is attached the bottom armature 14 by means of sleeves 32 into which the armature 14 is inserted. Sleeves 32 are preferably constructed from the floor 30 material by folding and sewing the edges thereby forming the sleeves. The sleeves 32 will have openings 34 for permitting the armature 14 to be inserted therein. Also, attached to the floor 30 is a handle 35 which permits the play yard to be easily carried in its folded configuration which is described in more detail below.

The end portions 24 of envelope 20 are also sewn to the sleeves 32. Also, end portions 24 are attached to the second armature 16 by means of another sleeve 36 as shown in both FIGS. 1 and 3.

Figure 4:
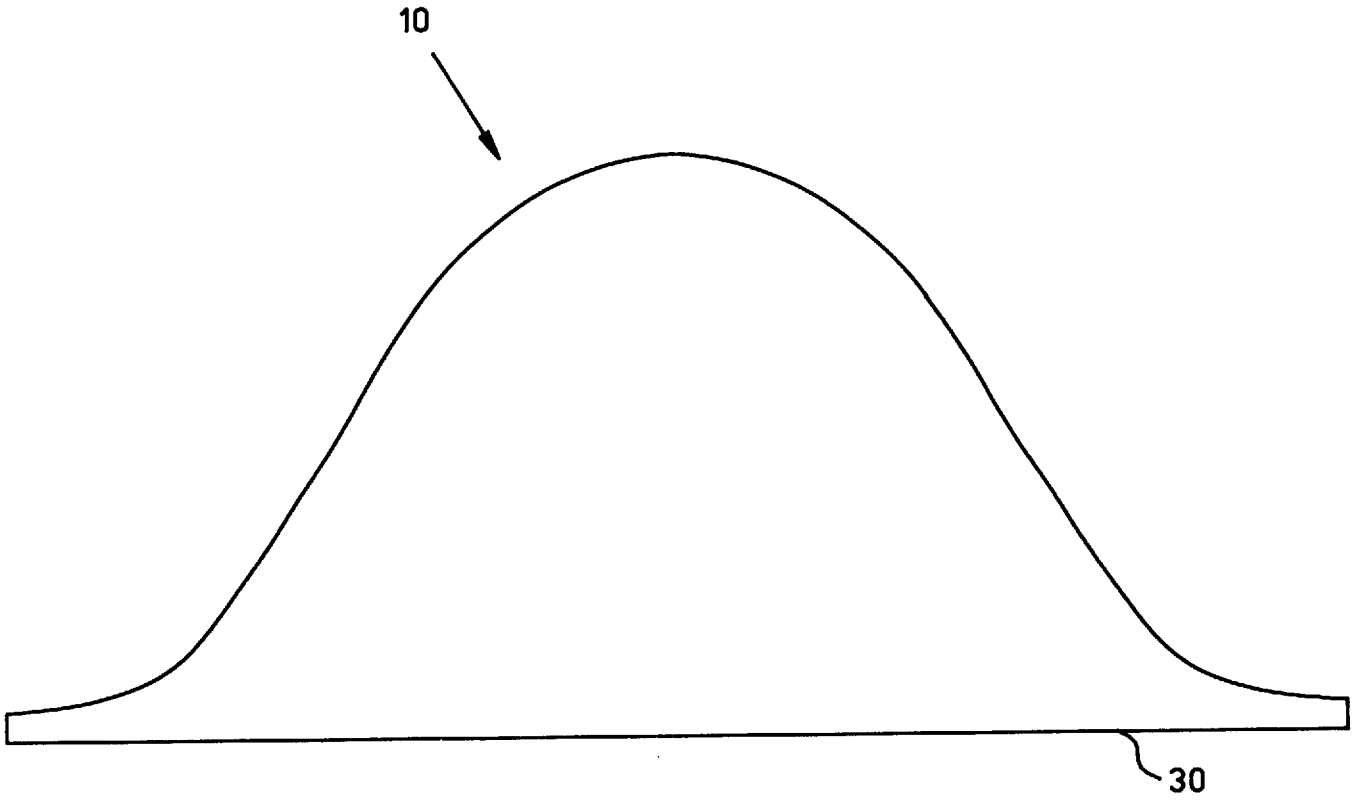
FIG. 4 is an end view of the play yard in accordance with the present invention.
Figure 5:
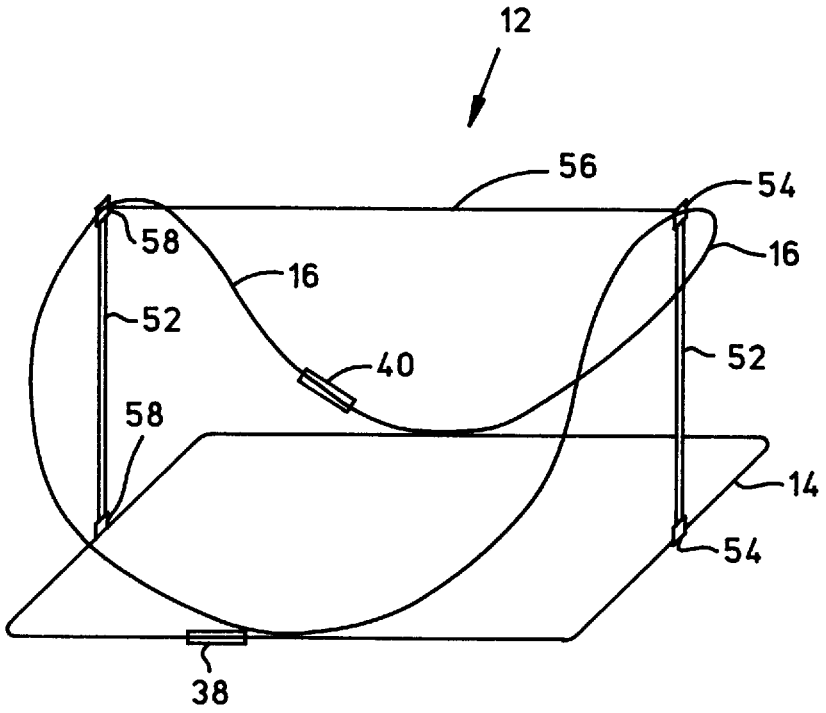
FIG. 5 is a perspective view of the frame of the play yard of the present invention.
Figure 6:
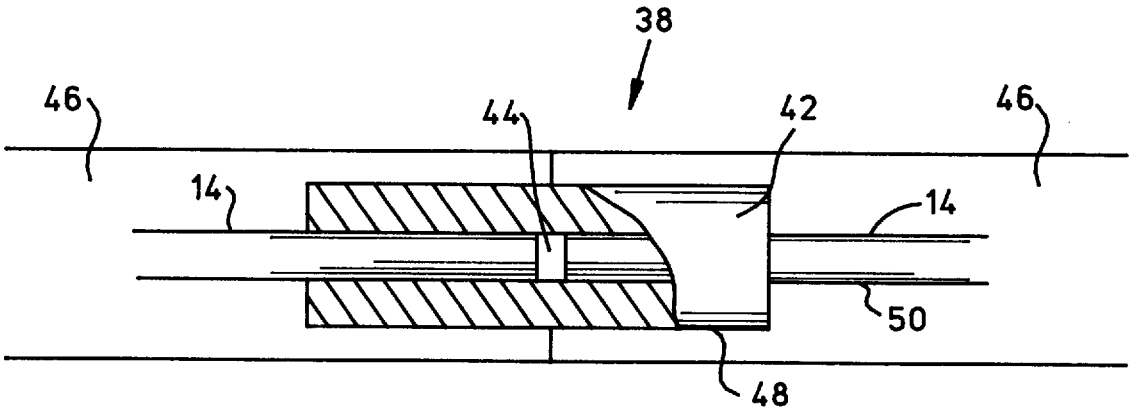
FIG. 6 is a cross-sectional view of the frame connector in accordance with a preferred embodiment of the present invention.

Referring now to FIGS. 4, 5 and 6, the frame 12 of the play yard 10 is shown without the envelope 20. As shown specifically in FIGS. 5 and 6, each armature 14, 16 includes a connector 38, 40 shown in detail in FIG. 6. It will be appreciated that armatures 14 and 16 are kept in proximity to each other near connectors 38, 40 by the envelope 20, specifically by sleeves 32, 36. However, connector 38 serves to connect the two ends of armature 14, and connector 40 serves to connect two ends of armature 16.

Referring now to FIG. 6, connector 38 is shown. It should be noted that connector 40 is essentially identical to connector 38 except that it connects the ends of armature 16 instead of armature 14. In more detail, connector 38 comprises a metal sleeve 42 having an axial bore 44 into which the two ends of armature 14 are inserted. The ends of the armature fit into the axial bore 44 such that rotational movement of the armature ends is easily allowed. It will be appreciated that having both end of armature 14 swivel contributes to the ease in which the play yard 10 is collapsed and opened.

However, it should also be noted that permitting the armature to freely swivel inside connector 42 could result in the armature 14 becoming detached from the sleeve 42. To prevent this from occurring, a plastic sleeve 46 is placed over the connector assembly 38. In particular, sleeve 46 may comprise a plastic, vinyl or other synthetic material and includes an opening 48 into which the connector 42 is inserted. In addition, sleeve 46 has an opening 50 into which the armature 14 is inserted. Sleeve 46 effectively serves to prevent armature 14 from coming out of the sleeve 42. In the preferred embodiment, sleeve 46 is comprised of a single piece running the full length of armature 14. It will also serve to protect the armature 14 from rust or corrosion. In other embodiments, sleeve 46 only is made a sufficient length to serve the purpose of restraining armature 14 within sleeve 42. In another embodiment, sleeve 46 is made of a plastic tube having a single size opening and is shrink fit around sleeve 42.

Referring again to FIG. 5, in a preferred embodiment of the present invention, a pair of vertical support bars 52 are attachable between the first and second armatures 14, 16. Each vertical support bar 52 contains a T-shaped snap connector 54 which provides a removable connection between the support bar 52 and the armature 14, 16. An opening or slot in the envelope pocket 32 or 36 may be employed to facilitate snapping the connector 54 to the armature.

It will be appreciated that vertical support bars 52 will add strength to the walls of the play yard. In accordance with conventional play yard product guidelines, it may be desirable to have the sides of the play yard support a weight of approximately 35 lbs. Thus, vertical support bars 52 allows a play yard 10 to meet this requirement. Support bars 52 are preferably made of a relatively strong material such as fiberglass or wire. Also in a preferred embodiment, a horizontal support bar 54 made of the same material as the vertical support bars 52, may be employed. Horizontal support 56 also employs snapping end connectors 58 similar to those in vertical supports 52. The purpose of the horizontal support bar 54 is to support mobiles or other toys which may be hung therefrom for the play yard occupant to play with. In addition, support bar 54 provides additional structural support strength for the play yard 10.

When it is desired to fold the play yard 10 up into a compact configuration, the user begins by folding the play yard along an axis adjacent to the openings 34 in the sleeves 32. The play yard is then folded again along an orthogonal axis at the point where the two ends where joined in the first fold. The edge such as 34 is then tucked back during folding until the play yard collapse into a flat disk. For further details of the folding procedure for structures of this nature, see for example, U.S. Pat. No. 5,163,461 discussed below.

The once folded play yard can then be tied down and kept in the folded configuration for transportation or storage. For example, the play yard may be then fitted into a pouch or bag to force it to remain in a folded up configuration, alternatively, straps and snaps may be employed to hold the play yard together in the folded configuration. When released, the play yard will spontaneously deploy into a fully erected play yard. If utilized, vertical supports 52 and horizontal support 54 may then be snapped into place. It should be noted that various modifications may be made to the preferred embodiments discussed above. For example, the frame may be constructed utilizing only a single continuous armature or more than two armatures as an alternative to the two armature frame disclosed in the present application. In particular, a single armature frame may be utilized such as the one disclosed in U.S. Pat. No. 4,163,461, which is incorporated herein by reference. Also, a frame utilizing more than two armatures may be employed such as the one disclosed in U.S. Pat. No. 4,858,634, which is also incorporated herein by reference. Those skilled in the art can appreciate that other advantages can be obtained from the use of this invention and that modification may be made without departing from the true spirit of the invention after studying the specification, drawings and following claims.

What is claimed is:

1. A portable playpen, comprising:

a flexible frame with at least two loops, the at least two loops including a bottom loop and an elevated loop contacting the bottom loop at two points and elevated from the bottom loop at other points;

the flexible frame adapted to be transformed into a collapsed configuration and into an expanded configuration;

an envelope of material covering the frame for forming a play area when the frame is in the expanded configuration; and the envelope including:

a first portion substantially enclosing the bottom loop;

a second portion substantially enclosing the elevated loop; and an opening permitting access to the playpen.

2. The portable playpen of claim 1, wherein the second portion includes a top portion.

3. The portable playpen of claim 2, wherein the opening is in the top portion.

4. The portable playpen of claim 2, wherein the frame material in the top portion includes a mesh.

5. The portable playpen of claim 1, wherein the frame includes a resilient filiform member.

6. The playpen of claim 5, wherein the resilient filiform member has at least two ends, the portable playpen further including a connection means for swivelingly connecting the two ends.

7. The portable playpen of claim 6, wherein the resilient filiform member has an outside diameter and the connection means include:

a cylindrical connector having an outside diameter and an axial opening, said ends being inserted into opposite ends of said axial opening, the cylindrical connector permitting said ends to independently swivel inside said axial opening during said transformation of the playpen between the collapsed and expanded configurations;

a tubular cover containing an axial opening conforming to the outside diameter of the resilient filiform member; and one end of said tubular cover having an enlarged opening portion conforming to the diameter of said cylindrical connector, wherein one end of said cylindrical connector is inserted into said enlarged opening and said resilient filiform member is inserted into said axial opening, whereby said resilient filiform member is constrained from being pulled out of said cylindrical connector by said tubular cover.

8. The portable playpen of claim 1, the envelope of material further including two opaque portions opposite each other.

9. The portable playpen of claim 1, wherein the bottom loop is in the shape of a rectangle with rounded corners.

10. An erectable playpen, comprising:

a frame formed from at least two loops including a first loop and a second loop capable of being elevated with respect to the first loop, the second loop contacting the first loop at two points;

the frame adapted to be transformed into a first configuration in which the playpen is folded and a second configuration in which the second loop is elevated with respect to the first loop and the playpen is erected; and an envelope of material covering the frame and forming the playpen when the frame is in the second configuration;

the envelope including:

a first portion substantially enclosing the first loop;

a second portion substantially enclosing the second loop; and an opening permitting access to the playpen.

11. The portable playpen of claim 10, wherein the second portion includes a top portion.

12. The portable playpen of claim 11, wherein the opening is in the top portion.

13. The portable playpen of claim 11, wherein the frame material in the top portion includes a mesh.

14. The portable playpen of claim 10, wherein the frame includes a resilient filiform member.

15. The playpen of claim 14, wherein the resilient filiform member has at least two ends, the portable playpen further including a connection means for swivelingly connecting the two ends.

16. The portable playpen of claim 15, wherein the resilient filiform member has an outside diameter and the connection means include:

a cylindrical connector having an outside diameter and an axial opening, said ends being inserted into opposite ends of said axial opening, the cylindrical connector permitting said ends to independently swivel inside said axial opening during said transformation of the playpen between the collapsed and expanded configurations;

a tubular cover containing an axial opening conforming to the outside diameter of the resilient filiform member; and one end of said tubular cover having an enlarged opening portion conforming to the diameter of said cylindrical connector, wherein one end of said cylindrical connector is inserted into said enlarged opening and said resilient filiform member is inserted into said axial opening, whereby said resilient filiform member is constrained from being pulled out of said cylindrical connector by said tubular cover.

17. The portable playpen of claim 10, the envelope of material further including two opaque portions opposite each other.

18. The portable playpen of claim 10, wherein the bottom loop is in the shape of a rectangle with rounded corners.

* * * * *